US005807217A

United States Patent [19]

Endelman

[11] Patent Number: 5,807,217

[45] Date of Patent: Sep. 15, 1998

[54] RING SHAPED EXERCISE APPARATUS

[76] Inventor: Ken Endelman, 7500-14th St., Suite 23, Sacramento, Calif. 95820-3539

[21] Appl. No.: 899,997

[22] Filed: Jul. 24, 1997

[51] Int. Cl.[6] ..... A63B 21/02

[52] U.S. Cl. ..... 482/122; 402/126; 402/127; 402/128

[58] Field of Search ..... 482/121, 122, 482/126, 127, 128

[56] References Cited

U.S. PATENT DOCUMENTS

| | | | |
|---|---|---|---|
| 1,551,459 | 8/1925 | Blakoe | 482/126 |
| 5,342,273 | 8/1994 | Plendl et al. | 482/126 |
| 5,735,781 | 4/1998 | Pai | 482/126 |

*Primary Examiner*—Lynne A. Reichard

*Attorney, Agent, or Firm*—John R. Wahl; Holland & Hart LLP

[57] ABSTRACT

A cushioned exercise apparatus is disclosed which preferably includes a single spring steel band or strap coiled into a plurality of spiral wraps forming a circular ring and a pair of handles fastened to the ring. This ring and handle assembly is covered with an enclosing and cushioning layer of rubber or elastomeric plastic material substantially enclosing the assembly and forming a hermetic seal around the assembly to prevent moisture from entering into and damaging the coiled strap ring. The cover also provides a comfortable, cushioning non-slip surface for contact with the user's skin, hands and/or legs during exercise.

16 Claims, 3 Drawing Sheets

RING SHAPED EXERCISE APPARATUS

BACKGROUND OF THE INVENTION

1. Field of the Invention

This invention generally relates to resistance exercise devices and more particularly to an elastically deformable circular ring shaped device.

2. Description of the Related Art

An elastically deformable ring shaped exercise device commonly known as a "magic circle" has been utilized by dancers and others for a number of years to strengthen inner thigh muscles and chest muscles by squeezing the sides of the ring together, either with the knees or hands. The magic circle is a circular ring made of an elongated spring steel strap wound in a coil of two, three or four flat spring steel wraps. The ends of the wraps of the ring are fastened to wood handles at diametrically opposite locations around the ring.

The magic circle is preferably used, for example, by placing the device between one's legs with the handles engaging the thighs about 2–8 centimeters above the knees. The user then squeezes his or her legs toward each other to deform the device to an oval shape against the reactionary spring pressure of the deforming ring.

One disadvantage with the conventional magic circles in use today is that they are very prone to rust buildup due to exposure to salty sweat during use. The user often sweats during exercise and this sweat may drip onto the steel wraps of the device, often flowing into and being trapped between the wraps. This moisture then accelerates corrosion of the adjacent wrap surfaces and limits the life of the device as well as degrades its appearance.

Several approaches have been tried over the years to preclude or at least minimize these detrimental effects of sweat contact with the spring steel wraps or bands of the device. The steel strap has been dipped in a rust inhibitor prior to assembly to the handles, the steel strap has been glazed, painted, etc. all with only limited success since there is movement between the hoops or wraps of the strap which eventually wears the rust inhibitor off of the band surface. Therefore there remains a need for a more permanent solution to this problem.

SUMMARY OF THE INVENTION

The apparatus in accordance with the present invention solves the above identified problem by enclosing the entire exercise device assembly including the handles and wraps of the steel band or strap in a unitary, flexible, polymeric cushion cover. A first embodiment of the apparatus in accordance with the present invention includes an assembly comprising a single spring steel band or strap coiled into a plurality of spiral wraps forming a circular ring and a pair of handles each attached to one end of the band and to each wrap and positioned diametrically opposite each other on the ring, and a cushioning cover of polymeric material, e.g. a rubber or elastomeric material, covering substantially all of the assembly, i.e., the ring and the pair of handles. Each handle comprises a generally curved flat metal plate having a central portion and opposite side portions wherein each of the side portions is folded over the central portion so as to form a channel therebetween receiving a portion of the circle of strap coils therein.

A second embodiment of the invention comprises an assembly which includes a single spring steel band or strap coiled into a plurality of spiral wraps forming a circular ring, a pair of handles, each of which comprises a one piece, molded curved plastic handle body having a central channel therein sized to receive the rim of the spring steel circle therein and a cover of rubber or elastomeric material substantially enclosing all of the ring and the pair of handles. Each of the handles is fastened to the wraps or coils preferably by at least one rivet passing through the handle, each of the coils and through one of the strap ends.

The cushioning cover of polymeric material may be a thermoplastic elastomer material or a thermoset elastomeric material or a flexible, compressable rubber such as a silicone rubber or a Neoprene formulation applied to the assembled ring and handles. The cushion cover may be applied by injection molding techniques or by dipping the assembled device into a liquid formulation and then allowing the coated assembly to cure. A plastisol formulation is presently preferred. The cover may also be formed by spraying or painting the cover on the assembly or by placing the assembly into a mold and injection molding the cover in place.

The resulting unitary device is a cushioned flexible exercise apparatus that is impervious to moisture and therefore rust free and fully protected from the detrimental effects of sweat and moisture. In addition, the coated or covered apparatus in accordance with the invention provides a cushioned, non slip surface for the user to handle permitting the user to stretch the apparatus or compress the apparatus comfortably between various parts of the body. These and other objects, features and advantages if the invention will become more apparent from a reading of the Detailed Description when taken in conjunction with the appended claims and the following drawing.

DETAILED DESCRIPTION OF THE INVENTION

Figure 1:
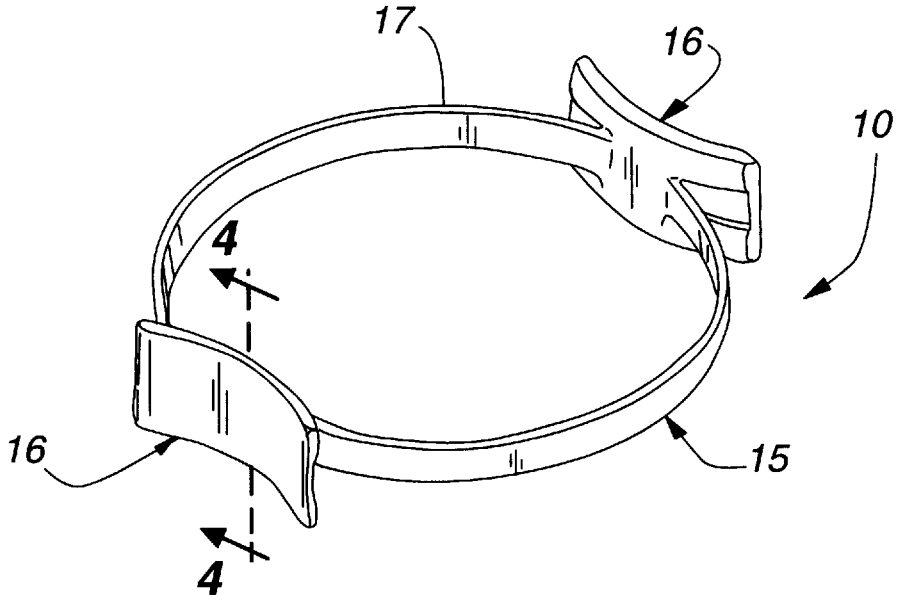
FIG. 1 is a perspective of the exercise apparatus in accordance with the invention.
Figure 2:
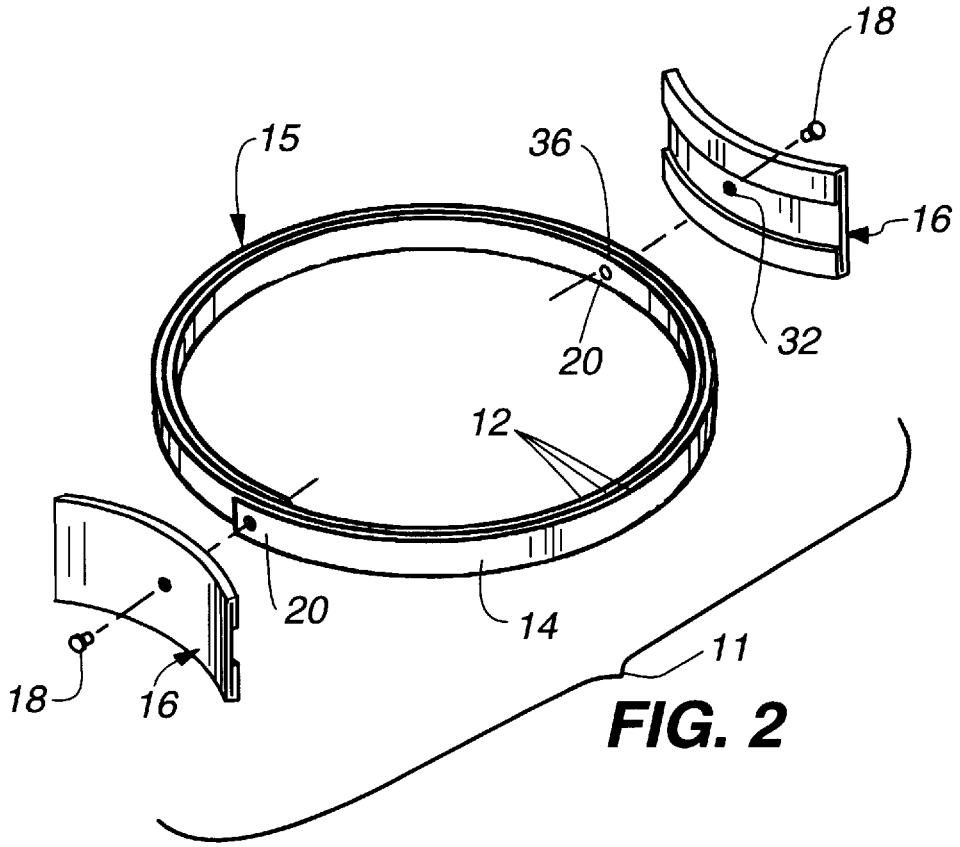
FIG. 2 is a perspective view of the circle strap and handle assembly in the apparatus in accordance with the invention.
Figure 3:
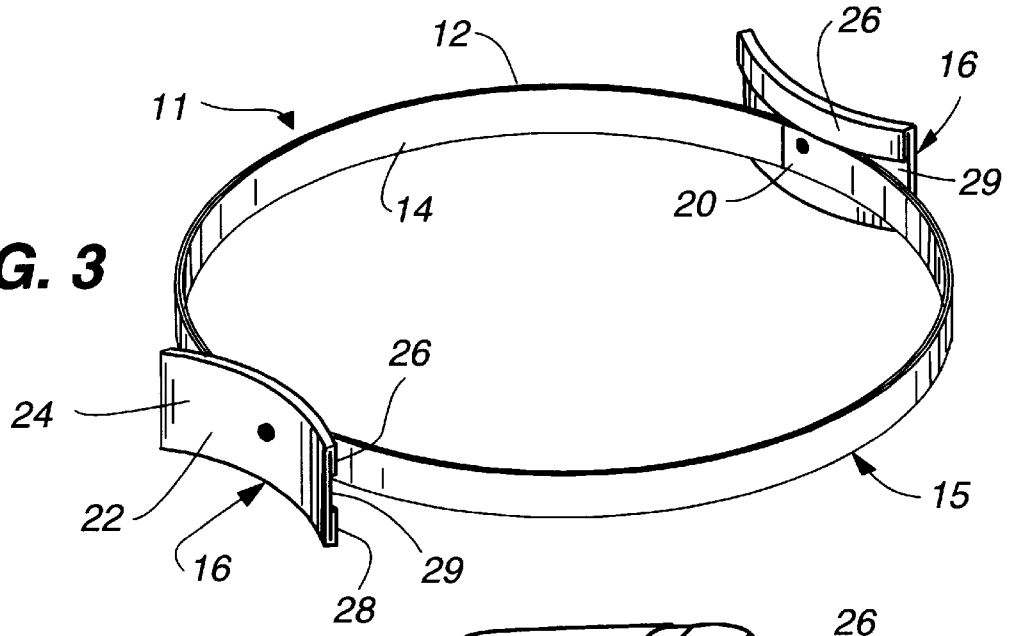
FIG. 3 is an exploded perspective view of the assembly in the exercise apparatus in accordance with the invention as in FIG. 2.

Referring now to the drawing, a perspective view of the exercise apparatus 10 in accordance with the present invention is shown in FIG. 1. The apparatus 10 comprises an assembly 11 (separately shown in FIG. 2 and in an exploded view in FIG. 3) of a plurality of coils or spiral wraps 12 of a spring steel strap 14 formed in a circle 15, and a pair of handles 16 and a cushioning cover 17. The handles 16 are each fastened by at least one rivet 18 to the wraps 12 on opposite sides of the circular ring 15 formed by the strap 14. Preferably there are three coils or wraps of the strap 14, although any number of coils may be used and preferably each of the strap ends 20 underlies one of the handles 16 on opposite sides of the circular ring 15.

Each of the handles 16 has an outer surface 22 which is curved opposite to the curvature of the circular ring 15. This curved outer surface 22 is preferably flat in a transverse direction parallel to the axis through the circular ring 15. The handle 16 is preferably formed of a flat rectangular piece of metal such as sheet aluminum or steel which has a central portion 24 and two spaced apart side portions 26 and 28. The side portions 26 and 28 are folded over the central portion 24 so as to form a channel 29 therebetween and then the folded plate is bent to form the curved handle 16. The handle 16 is placed on the coiled strap 14 such that one 20 of the strap 14 fits within the channel 29 between the side portions 26 and 28. A rivet 18 is then pressed through pre-drilled holes 32 in the central portion of the handle 16, through holes 34 in each wrap 12 of the strap 14, and through a hole 36 in the end portion 20 of the strap 14. The rivet 18 is then flared to secure the handle 16 to the strap 14. The facing edges of the sides 26 and 28 abut against the wraps 12 of the strap 14 in the channel 29 to prevent the handle 16 from twisting movement during use.

The holes 34 through each wrap 12 of the strap 14 are sized slightly larger in diameter than the rivet 18 so that the wraps 12 may move relative to one another during flex of the apparatus in use. The holes 36 through the end portions 20 of the strap 14 are sized such that they frictionally receive the rivets 18.

Figure 4:
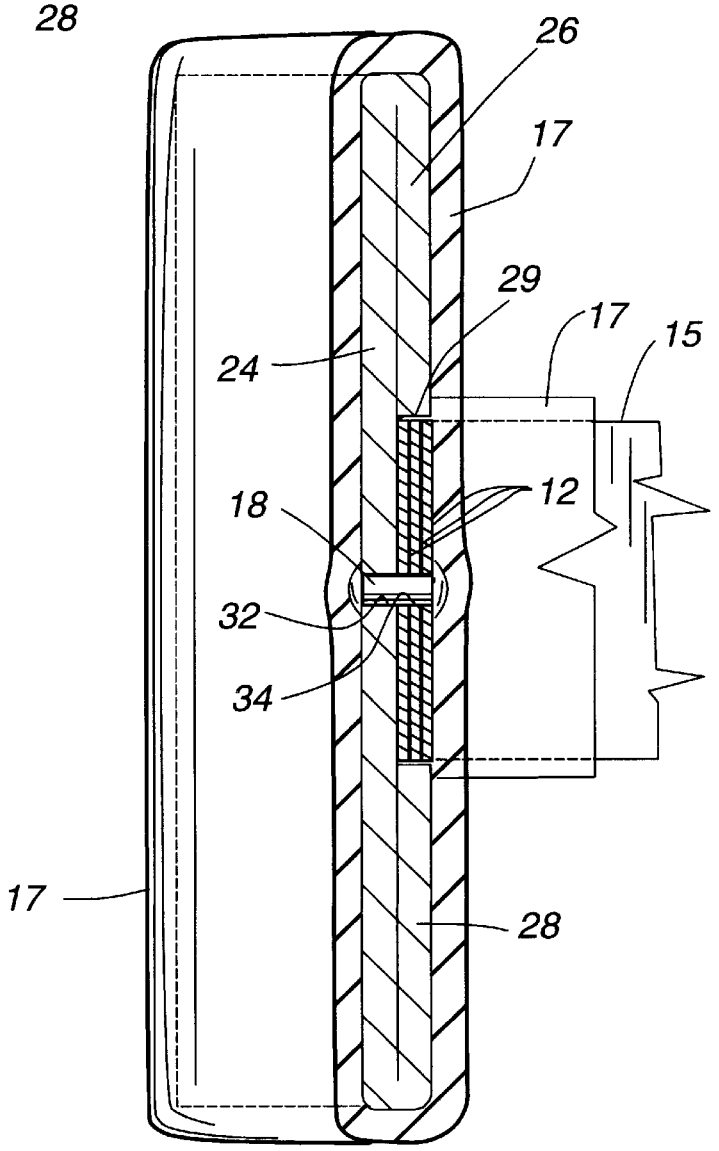
FIG. 4 is a sectional view of the exercise apparatus in accordance with the invention taken along the line 4—4 in FIG. 1.

A sectional view of the apparatus 10 shown in FIG. 1 is shown in FIG. 4 The cover 17 completely surrounds and encloses the assembly 11 and provides a seal against moisture intrusion into the assembly 11. After the handles 16 are riveted to the strap 14, the assembly 11 may be placed in a mold (not shown) and the cover 17 injection molded onto the assembly 11. The cover 17 may also be formed on the assembly 11 by dipping the assembly into a container of liquefied elastomeric resin material or liquid rubber. Presently, liquid plastisol formulation is preferred, which is commercially available from several sources, such as Plastomerc Corporation. The covered assembly 11 of the coiled wraps 12 of the strap 14 and two handles 16 is removed from the vat of liquid plastisol and allowed to cure forming the resilient cushioning cover 17 over the strap and handle assembly 11 in accordance with the invention. Alternatively, the cushioning coating forming the cover 17 may be sprayed onto the assembly 11 and then allowed to cure or it may be applied to the assembly 11 by molding the cover in place onto an assembly 11 placed in a mold.

It is to be understood that other polymeric materials may also be used. For example, many other rubber or elastomeric materials such as an ethylene propylene dimer (EPDM), Neoprene or silicone rubber material may be advantageously utilized in place of the plastisol described specifically herein. Also, a closed cell or open cell foam elastomeric material may also be used with a closed cell formulation being preferred. The resilient cushioning cover material, when installed on the assembly 11, is preferably less than about ¼ inch thick and is more preferably between about an eighth to 3/16 inches thick and preferably provides a non-slip gripping surface to the user so that the user can securely position the apparatus 10 between various parts of his or her body to perform exercises. Thickened regions of the cover 17 may also be provided in areas where user contact is normally anticipated, such as over the handle surfaces.

Figure 5:
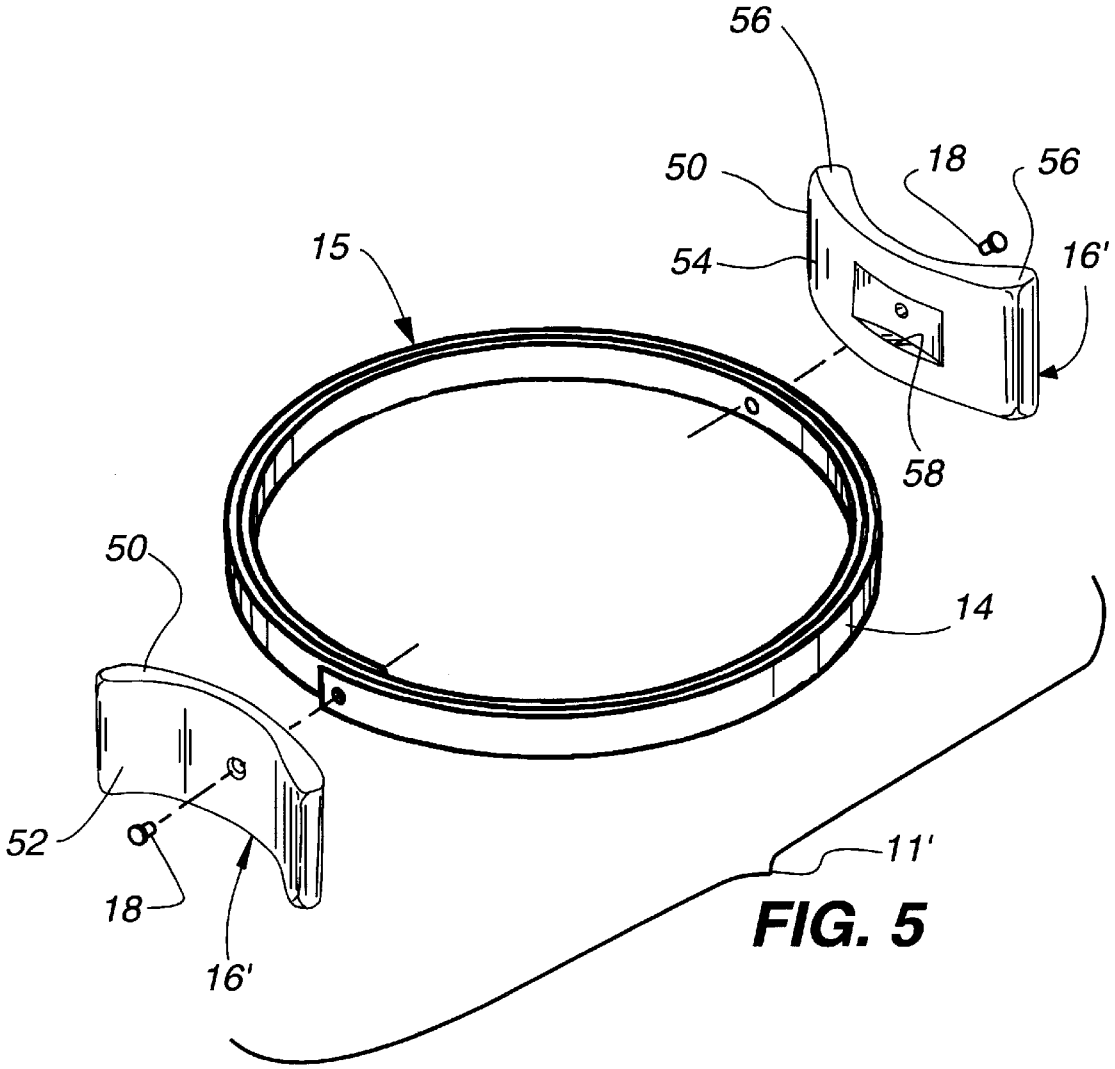
FIG. 5 is a perspective view as in FIG. 2 of a second embodiment of the ring and handle assembly in the exercise apparatus in accordance with the invention.

A second embodiment of the invention uses an assembly 11' shown in FIG. 5. This embodiment is identical to the assembly in the first embodiment just described except that each of the handles 16' is an injection molded elongated plastic body 50. The plastic body 50 has a curved outer surface 52 and an inner surface 54 and thickened opposite end portions 56. The inner surface 54 has a longitudinal channel 58 therein between the end portions 56 adapted to receive the strap 14 therein as in the first embodiment. The strap 14 is fastened to the handle 16' via at least one rivet or bolt as in the first embodiment. The assembly 11' is then dipped to form the cover 17 or placed in a mold and the cover 17 injection molded as above described.

Other configurations of the exercise apparatus in accordance with the invention may also be provided. For example, the handles 16 may be fastened to the strap 14 with two rivets side by side prior to installing the cover 17. In this instance, the channel 58 may be omitted from the handles 16 as the two rivets will prevent undesired handle rotation. Alternatively, bolts and nuts may be used. The strap 14 may alternatively be made of a molded plastic or fiberglass material with the required strength and elastic modulus. The handles 16 may also be made from a plastic material, preferably injection molded in their final shape with an open channel to receive the hoop wraps of the strap 14. The width of the strap 14 may also be enlarged to about two inches and the handles 16 omitted from the assembly 11. Other changes will also be apparent to those skilled in the art from a reading of this specification. The embodiments described above are provided as examples and not by way of limitation. Accordingly, it is intended that the invention include all such modifications, alternatives and variations as defined by the broad scope and fair meaning of the appended claims.

What is claimed is:

1. An exercise apparatus comprising an assembly comprising a resilient spring strap having a plurality of spiral wraps forming a circular ring and a cushioning cover of polymeric material substantially enclosing all of the assembly.

2. The exercise apparatus according to claim 1 wherein said assembly includes a pair of handles each attached to one end of the strap and to each wrap and positioned diametrically opposite each other on the ring.

3. The exercise apparatus according to claim 2 wherein each of said handles is formed of a single piece of flat sheet metal having a central portion and opposing side portions folded over said central portion and adapted to receive said strap therebetween.

4. The exercise apparatus according to claim 3 wherein said side portions define a channel therebetween holding said strap and preventing rotation of said strap and said handle.

5. The exercise apparatus according to claim 2 wherein said cover is made of plastisol.

6. The exercise apparatus according to claim 5 wherein each of said handles is a metal body having a curved surface and an inner surface with a channel in said inner surface receiving a portion of said circular ring therein.

7. The exercise apparatus according to claim 2 wherein each of said handles is riveted to said ring.

8. The exercise apparatus according to claim 1 wherein said cover is made of plastisol.

9. An exercise apparatus comprising an assembly of a circular ring formed by a resilient spring strap having a plurality of spiral wraps and a pair of handles, each fastened to one end of the strap and to each wrap and positioned diametrically opposite each other on the ring, and a cover of polymeric material substantially covering and enclosing the ring and the pair of handles wherein each of said handles has a curved face facing outwardly away from said ring.

10. The apparatus according to claim 9 wherein said cover is made of a plastisol formulation.

11. The apparatus according to claim 10 wherein said plastisol cover has a thickness of less than about ¼ inch.

12. The apparatus according to claim 9 wherein each handle is riveted to said strap and each of said wraps.

13. An exercise apparatus comprising an assembly of a circular ring formed by a resilient spring strap having spiral wraps and a pair of handles each fastened to one end of the strap and to each wrap and positioned diametrically opposite each other on the ring, wherein each of said handles is a curved solid body having an outer curved side facing away from said ring and an inner side defining a channel therein receiving said ring, said body having thickened end portions adjacent either end of said channel, and a cover of polymeric material substantially covering and enclosing the ring and the pair of handles providing a cushioning surface for contact with a portion of a user's body.

14. The apparatus according to claim 13 wherein each of said handles is made of plastic.

15. The apparatus according to claim 14 wherein each of said handles is an injection molded plastic body.

16. The apparatus according to claim 13 wherein said cover is made of a plastisol material.

* * * * *

UNITED STATES PATENT AND TRADEMARK OFFICE

CERTIFICATE OF CORRECTION

PATENT NO. : 5,807,217
APPLICATION NO. : 08/899997
DATED : September 15, 1998
INVENTOR(S) : Ken Endelman It is certified that error appears in the above-identified patent and that said Letters Patent is hereby corrected as shown below:

Title page 1, at Item (22) Filed:

Please delete, "Jul. 24, 1997" and insert -- Jul. 23, 1997 --.

Signed and Sealed this

Twenty-ninth Day of January, 2008

JON W. DUDAS
*Director of the United States Patent and Trademark Office*